United States Patent [19]

Rothfuss et al.

[11] Patent Number: 4,995,596

[45] Date of Patent: Feb. 26, 1991

[54] APPARATUS FOR REPAIRING A PERFORATED BRICK IN A METALLURGICAL VESSEL

[75] Inventors: Hans Rothfuss, Taunusstein; Peter Keutgen, Kreuzau, both of Fed. Rep. of Germany

[73] Assignee: Didier-Werke AG, Wiesbaden, Fed. Rep. of Germany

[21] Appl. No.: 413,675

[22] Filed: Sep. 28, 1989

[30] Foreign Application Priority Data

Oct. 1, 1988 [DE] Fed. Rep. of Germany ..... 3833506

[51] Int. Cl.[5] ..... C21B 7/04

[52] U.S. Cl. ..... 266/281; 266/217

[58] Field of Search ..... 266/220, 270, 281, 280, 266/217, 265; 264/30

[56] References Cited

U.S. PATENT DOCUMENTS

| | | | |
|---|---|---|---|
| 3,833,334 | 9/1974 | Riley | 266/281 |
| 4,023,781 | 5/1977 | Fritz et al. | 266/281 |
| 4,589,635 | 5/1986 | Reichard et al. | 266/220 |
| 4,779,849 | 10/1988 | Rothfuss et al. | 266/270 |

FOREIGN PATENT DOCUMENTS

| | | | |
|---|---|---|---|
| 105868 | 4/1984 | European Pat. Off. . | |
| 137961 | 4/1985 | European Pat. Off. . | |
| 181853 | 5/1986 | European Pat. Off. . | |
| 1608036 | 12/1970 | Fed. Rep. of Germany . | |
| 3240097 | 5/1984 | Fed. Rep. of Germany . | |
| 3316459 | 11/1984 | Fed. Rep. of Germany . | |
| 3538498 | 5/1987 | Fed. Rep. of Germany . | |
| 3623609 | 1/1988 | Fed. Rep. of Germany . | |
| 3716920 | 12/1988 | Fed. Rep. of Germany . | |
| 0149885 | 8/1985 | Japan | 266/281 |
| WO88/06191 | 8/1988 | World Int. Prop. O. . | |

*Primary Examiner*—S. Kastler

*Attorney, Agent, or Firm*—Wenderoth, Lind & Ponack

[57] ABSTRACT

An apparatus repairs a perforated brick employed in a wall of a metallurgical vessel and having an opening into which is to be fit a gas washing sink for introducing gas into molten metal within the metallurgical vessel, during which gas introduction the inner end of the gas washing sink and the perforated brick around such area become worn. The apparatus includes a casing having an outer contour corresponding to the outer contour of the gas washing sink and to be inserted into the worn opening of the perforated brick upon removal therefrom of the worn gas washing sink. The casing thus forms a template defining the contour of the opening to be repaired in the worn portion of the perforated brick. A repair material feed pipe extends through and is guided by the casing for supplying therethrough repair material for repairing the worn portion of the perforated brick. A spray head is attached to the inner end of the feed pipe for directing the repair material toward the worn portion of the perforated brick.

25 Claims, 1 Drawing Sheet

APPARATUS FOR REPAIRING A PERFORATED BRICK IN A METALLURGICAL VESSEL

BACKGROUND OF THE INVENTION

The present invention relates to an apparatus for repairing a perforated brick in a wall of a metallurgical vessel, the perforated brick having an opening into which is to be fit a gas washing sink or brick for introducing gas into a molten metal within the metallurgical vessel, during which operation the perforated brick becomes worn, particularly around the area of the opening therein.

During an operation of introducing gas for a gas washing sink into molten metal within a metallurgical vessel, the inner end of the gas washing sink becomes eroded and worn. This wear itself relatively easy is corrected by simply replacing the gas washing sink or brick. However, the perforated brick also becomes worn or eroded, particularly in an area or portion thereof surrounding the opening therein and enclosing the gas washing sink. It is not economically feasible to replace the perforated brick, since this a very difficult operation. Accordingly, the worn area or portion of the perforated brick must be mended or repaired. Such repair operation conventionally is achieved by, after a new gas washing sink or brick is introduced into the opening in the worn perforated brick, introducing a long lance or supply pipe from the open, normally upper, end of the metallurgical vessel and spraying a mending or repair compound into the vicinity of the gas washing sink positioned in the perforated brick. The object of course is to fill the repair material into the worn area of the perforated brick surrounding the new gas washing sink. This however is a very difficult operation, and as a practical matter the repair material is not accurately targeted and is directed not only to worn areas of the perforated brick but also to all adjacent areas thereof. Most importantly however, the repair material becomes directed against the inner end of the gas washing sink. This clogs the gas washing sink. As a result, the inner surface of the gas washing sink must be freed of the thus deposited repair material in a subsequent operation. This known manner of repairing or mending the worn area of a perforated brick is very time consuming and requires substantial care.

SUMMARY OF THE INVENTION

With the above discussion in mind, it is the object of the present invention to provide an apparatus that enables the worn or eroded area of a perforated brick to be repaired in a simple and selective, as well as time-saving, manner, while avoiding the above and other prior art disadvantages.

This object is achieved in accordance with the present invention by the provision of a repair apparatus including a casing having an outer contour corresponding to the outer contour of a new gas washing sink and adapted to be inserted into the opening of the perforated brick upon removal therefrom of the gas washing sink. The casing thus forms a template that defines the contour of the opening in the worn portion of the perforated brick, i.e. the contour of the opening to be achieved after repair of the worn portion of the perforated brick. Means, particularly a feed pipe, extends through and is guided by the casing and supplies therethrough repair or mending material or compound for repairing the worn portion of the perforated brick.

Means, particularly a spray head, is attached to the inner end of the feed pipe and directs the repair material specifically toward the worn area or portion of the perforated brick.

By use of this unique apparatus in accordance with the present invention it is possible to mend or repair the worn area of the perforated brick in a very simply manner. Thus, after a worn gas washing sink is removed from the opening of the worn or eroded perforated brick, the casing simply is pushed into the opening in the worn perforated brick. Thus, the casing occupies the volume that would be occupied by a new gas washing sink, and specifically the volume that will be occupied by a new gas washing sink after the repair operation. The mending or repair material or compound then is supplied through the feed pipe and is sprayed or directed by the spray head selectively and directly toward the worn area of the perforated brick surrounding the inner end of the casing. The repair material is supplied, for each of handling, from outwardly of the wall of the metallurgical vessel in which the perforated brick is installed. Thus, a long lance or supply pipe introduced and guided from the open upper end of the metallurgical vessel, as employed in the prior art, is not necessary. After the repair material has hardened, the casing simply is removed from the opening in the repaired perforated brick, and the feed pipe and spray head are simultaneously removed. A new gas washing sink or brick then can be installed in the opening in the repaired perforated brick. Thus, there obviously no longer will be any danger of spraying repair material onto the inner end surface of the new gas washing sink.

Preferably the spray head includes means, for example nozzles, for discharging the repair material toward the worn portion of the perforated brick in a direction of between 90° to 180° with respect to the direction of flow of the repair material through the feed pipe. In this manner the discharge direction of the repair material is directly toward the normal worn area or portion of the perforated brick in the vicinity of the opening to be formed therein after the repair operation and into which is to be inserted a new gas washing sink or brick.

In accordance with a preferred feature of the present invention, the feed pipe and thus the spray head are guided for axial and rotary movement relative to the casing. In other words, the feed pipe and spray head can be moved longitudinally of the axis of the casing and/or be rotated about such axis. This rotation permits the spray head to be adjusted in such a manner that the worn area can have uniformly applied thereto the repair material. This longitudinal movement similarly enables the repair material to be directed to the worn area, particularly when the worn area is of substantial extent.

In accordance with a still further preferred feature of the present invention, there is provided means for preventing the repair material from entering the interior of the casing. Such means may be in the form of a plate-shaped member connected to the feed pipe and having a diameter substantially equal to the diameter of the inner end of the casing. A peripheral collar or skirt member is attached to the plate-shaped member and extends axially therefrom into the interior of the casing. This structure prevents the repair material from entering into the interior of the casing. The skirt member may have an axial length that will define the length of an operating stroke by which the feed pipe may be moved axially of the casing while still preventing repair material from entering the interior of the casing.

BRIEF DESCRIPTION OF THE DRAWINGS

Other objects, features and advantages of the present invention will be apparent from the following detailed description of a preferred embodiment thereof, with reference to the accompanying drawings, wherein.

DETAILED DESCRIPTION OF THE INVENTION

Figure 1:
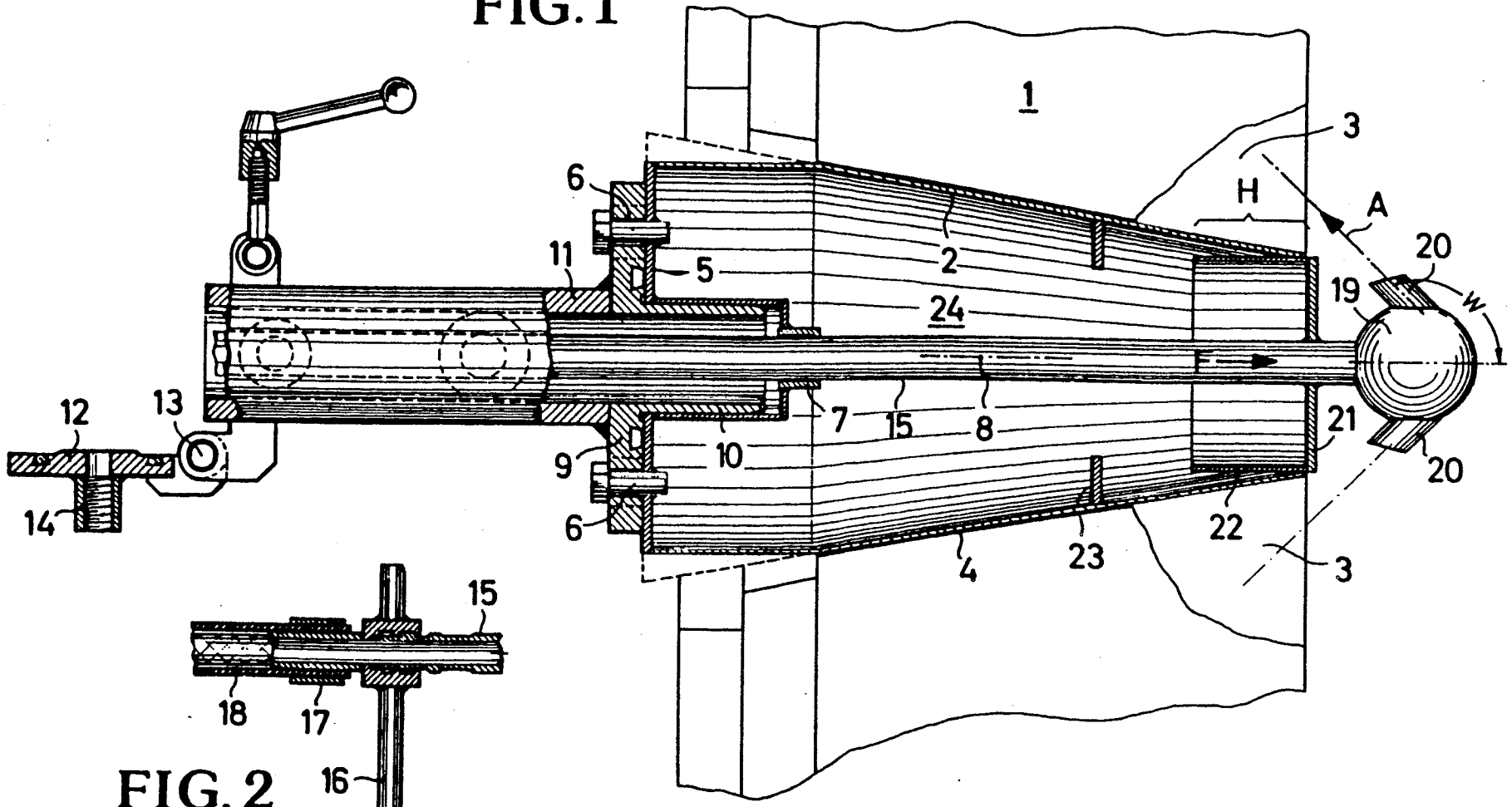
FIG. 1 is a longitudinal view, substantially in cross section, of an apparatus according to the present invention.

Shown schematically in FIG. 1 is a portion of a wall of a metallurgical vessel having installed therein a perforated brick 1 having extending therethrough an opening 2. During a normal operation of introducing gas into molten metal to be contained within the metallurgical vessel, a gas washing sink including a refractory brick is introduced into the opening 2, and gas passes through the gas washing sink into the molten metal. During such operation the inner end of the gas washing sink becomes worn and eroded and therefore periodically must be replaced. Additionally however, the area or portion 3 of the perforated brick surrounding opening 2 and the inner end of the gas washing sink therein also becomes worn and eroded. This worn area or portion 3 must be repaired, and such repair is achieved in accordance with the apparatus of the present invention.

Such apparatus includes a casing 4 having an interior 24 and an outer contour corresponding to the outer contour of a gas washing sink to be inserted into opening 2. Casing 4 is inserted into opening 2 of the perforated brick after removal therefrom of a worn gas washing sink. Casing 4 thus extends into the unworn portion of opening 2, but also continues into the worn or eroded area 3 and thus forms a template that defines the contour of the opening to be formed in the worn portion 3 after repair thereof. The casing 4 has a longitudinal axis 8 and a bottom or outer wall 5 that has extending therefrom into interior 24 a guide sleeve 7 that is arranged concentrically with longitudinal axis 8. A repair material feed pipe 15 extends through and is guided by guide sleeve 7. Feed pipe 15 thus extends coaxially of longitudinal axis 8 of casing 4. The inner end of feed pipe 15 has attached thereto a spray head 19 for directing repair material toward the worn portion 3 of the perforated brick 1.

Figure 2:
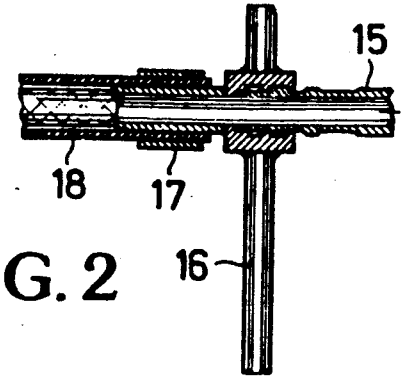
FIG. 2 is a substantially sectional view of an outer end of a repair material feed device employed in the apparatus of FIG. 1.

In accordance with the present invention, the feed pipe 15 can be moved longitudinally of the axis 8 and also can be rotated about such axis. For this purpose, an outer end of feed pipe 15 has connected thereto a handle 16 (FIG. 2). A repair material feed hose 15 is connected to the outer end of feed pipe 15 by a coupling 17.

In accordance with a particularly preferred arrangement illustrated in FIG. 1, a closure member 9, to be normally sealingly attached to a gas washing sink during a gas introducing operation, is detachably fastened to bottom 5 of casing 4, for example by means of bolts 6. Closure member 9 has a center projection 10 extending into bottom 5 so as to facilitate centering of casing 4 relative to closure member 9. Closure member 9 also has extending outwardly therefrom a tubular member 11 having on the outer end thereof a flap valve 12 pivoted about an axle 13 and having a gas inlet 14. During use of the closure member 9 in a gas introducing operation, flap valve 12 is closed and gas is introduced through gas inlet 14. When closure member 9 is used with the apparatus of the present invention, flap valve 12 is opened as shown in FIG. 1 and feed pipe 15 extends through tubular member 11, with handle 16 being connected to feed pipe 15 at a position outwardly or rearwardly of flap valve 12 by a distance sufficient to enable desired longitudinal movement of feed pipe 15. The use of the above described closure member 9 and associated elements facilitates mounting and attachment of the apparatus of the present invention.

In accordance with preferred features of the present invention, spray head 19 is provided with at least one nozzle 20, preferably at least two nozzles 20, that are arranged in such a manner that they deflect the repair material toward the worn portion 3 in directions extending at angles W with respect to flow direction F of the repair material and feed pipe 15. Preferably, angle W is greater than 90° and less than 180°, further preferably, for example, 135°. Thus, the direction A of the repair material toward the worn area 3 may be designed to be suitable for a given installation.

In accordance with a further feature of the present invention, there is provided means for preventing repair material from entering into the interior 24 of casing 4. Particularly, attached to an outer end portion of feed pipe 15, inwardly of spray head 19, is a plate or plate-shaped member 21 having an outer diameter just fitting into the opening in the inner end of casing 4. Extending, preferably axially, from plate 21 is an annular collar or skirt member 22 having an axial length defining the length of an operating stroke H by which feed pipe 15 may be moved axially of the casing while still preventing repair material from entering interior 24. Within interior 24 is positioned a stop 23, for example in the form of a ring, to be abutted by collar member 22 upon inward withdrawal of feed pipe 15 into casing 4.

The above described apparatus operates in the following manner. Thus, in the position of spray head 19 and feed pipe 15 illustrated in FIG. 1, outflow direction A is directed toward a worn area closest to casing 4. Repair material is sprayed from nozzles 20 into worn area 3. Plate 21 covers the interior 24 of casing 4 to prevent flow of the repair material into interior 24. Rotation of feed pipe 15 about axis 8 enables spray head 19 and nozzles, 20 to direct the repair material in a uniform distribution around the casing 4. In the event that the worn area 3 is larger, i.e. extending vertically upwardly and downwardly with respect to the illustration of FIG. 1, then feed pipe 15 may be moved axially further inwardly, i.e. to the right as illustrated in FIG. 1. This enables the spray head 19 and nozzles 20 to direct the repair material toward such additional, enlarged worn area of the perforated brick. As long as this axial movement of the feed pipe remains within the range of the working stroke H, plate 21 and skirt member 22 will prevent the repair material from entering the interior 24 of casing 4.

When sufficient repair material has been applied, the delivery of the repair material is stopped, and feed pipe 15 is withdrawn outwardly of casing 4 until skirt member 22 abuts stop ring 23. During such movement, spray head 19 and nozzles 20 will be withdrawn into the inner end of the interior 24 of the casing 4. After the repair material has hardened, as would be understood by one skilled in the art, the apparatus of the present invention is removed from the repaired opening 2 in the repaired perforated brick 1. Thereafter, a new gas washing brick can be inserted into the repaired opening 2. In accordance with the particular arrangement shown in FIG. 1, after withdrawal of the apparatus shown in FIG. 1, bolts 6 are removed such that casing 4 and feed pipe 15 are removed from closure member 6. Closure member 6 then is attached to the new gas washing sink, with projection 10 extending into a gas distribution change of such gas washing sink. Flap valve 12 is closed, the new gas washing sink is introduced into the repaired opening 2, and gas can be delivered via gas inlet 14 through the gas washing sink into the metallurgical vessel.

In accordance with a further, not illustrated feature of the present invention, a compressed air supply line can be connected to spray head 19, in addition to repair material feed pipe 15. Thus, the repair material can be sprayed by means of such compressed air through and from the nozzles 20 of spray head 19 so that the repair material does not settle in a merely meandering fashion in the worn area 3. Compressed air can be supplied through such a supply line that is arranged parallel, preferably coaxial, to feed pipe 15.

Although the present invention has been described and illustrated with respect to preferred features thereof, it is to be understood that various modifications and changes may be made to the specifically described and illustrated features without departing from the scope of the present invention.

We claim:

1. An apparatus for repairing a perforated brick employed in a wall of a metallurgical vessel and having an opening into which is to be fit a gas washing sink for introducing gas into molten metal within the metallurgical vessel, during which the perforated brick becomes worn, said apparatus comprising:

a casing having an outer contour corresponding to the outer contour of the gas washing sink and adapted to be inserted into the opening of the perforated brick upon removal therefrom of the gas washing sink, thereby to form a template defining the contour of the opening in a worn portion of the perforated brick;

a feed pipe, extending through and guided by said casing, for supplying therethrough repair material for repairing the worn portion of the perforated brick; and a spray head, connected to said feed pipe, for directing the repair material toward the worn portion of the perforated brick, said spray head includes means for discharging the repair material toward the worn portion of the perforated brick in a direction extending from 90° to 180° with respect to the direction of flow of the repair material through said feed pipe.

2. An apparatus as claimed in claim 1, wherein said discharging means comprises at least one nozzle formed on said spray head.

3. An apparatus as claimed in claim 2, wherein said spray head includes at least two said nozzles.

4. An apparatus as claimed in claim 1 wherein said casing includes means for guiding said feed pipe for axial and rotary movement relative thereto.

5. An apparatus as claimed in claim 4, further comprising means, attached to an end of said feed pipe outwardly of said casing, for enabling movement of said feed pipe axially and rotatably relative to said casing.

6. An apparatus as claimed in claim 5, wherein said movement enabling means comprises a handle connected to said feed pipe.

7. An apparatus as claimed in claim 4, wherein said guiding means comprises a guide sleeve incorporated into said casing and through which extends said feed pipe.

8. An apparatus as claimed in claim 1, further comprising means for preventing repair material from entering the interior of said casing.

9. An apparatus as claimed in claim 8, wherein said preventing means comprises a plate connected to said feed pipe.

10. An apparatus as claimed in claim 9, further comprising a skirt member attached to said plate and extending into the interior of said casing, said skirt member having an axial length defining the length of an operating stroke by which said feed pipe may be moved axially of said casing while still preventing repair material from entering the interior thereof.

11. An apparatus as claimed in claim 9 further comprising stop means within said casing for limiting axial movement of said feed pipe in a direction to withdraw said feed pipe from said casing.

12. An apparatus as claimed in claim 1, further comprising a compressed air supply line connected to said spray head.

13. An apparatus as claimed in claim 12, wherein said compressed air supply line extends parallel to said feed pipe.

14. An apparatus as claimed in claim 13, wherein said feed pipe and said compressed air supply line are arranged coaxially.

15. An apparatus as claimed in claim 1, further comprising a closure member, to be sealingly attached to the gas washing sink during a gas introducing operation, detachably fastened to said casing.

16. An apparatus for repairing a perforated brick employed in a wall of a metallurgical vessel and having an opening into which is to be fit a gas washing sink for introducing gas into molten within the metallurgical vessel, during which the perforated brick becomes worn, said apparatus comprising:

a casing having an outer contour corresponding to the outer contour of the gas washing sink and adapted to be inserted into the opening of the perforated brick upon removal therefrom of the gas washing sink, thereby to form a template defining the contour of the opening in a worn portion of the perforated brick;

a feed pipe, extending through and guided by said casing, for supplying therethrough repair material for repairing the worn portion of the perforated brick;

a spray head connected to said feed pipe, for directing the repair material toward the worn portion of the perforated brick;

said casing including means for guiding said feed pipe for axial and rotary movement relative thereto; and a handle, attached to an end of said feed pipe outwardly of said casing, for enabling movement of said feed pipe axially and rotatably relative to said casing.

17. An apparatus as claimed in claim 16, wherein said guiding means comprises a guide sleeve incorporated into said casing and through which extends said feed pipe.

18. An apparatus as claim in claim 16, further comprising means for preventing repair material from entering the interior of said casing.

19. An apparatus as claimed in claim 18, wherein said preventing means comprises a plate connected to said feed pipe.

20. An apparatus as claimed in claim 19, further comprising a skirt member attached to said plate and extending into the interior of said casing, said skirt member having an axial length defining the length of an operating stroke by which said feed pipe may be moved axially of said casing while still preventing repair material from entering the interior thereof.

21. An apparatus as claimed in claim 19, further comprising stop means within said casing for limiting axial movement of said feed pipe in a direction to withdraw said feed pipe from said casing.

22. An apparatus as claimed in claim 17, further comprising a compressed air supply line connected to said spray head.

23. An apparatus as claimed in claim 22, wherein said compressed air supply line extends parallel to said feed pipe.

24. An apparatus ad claimed in claim 23, wherein said feed pipe said compressed air supply line are arranged coaxially.

25. An apparatus as claimed in claim 16, further comprising a closure member, to be sealingly attached to the gas washing sink during a gas introducing operation, detachably fastened to said casing.

* * * * *